US007234280B2

(12) United States Patent
Nieto et al.

(10) Patent No.: US 7,234,280 B2
(45) Date of Patent: Jun. 26, 2007

(54) DEVICE FOR ANCHORING PRESTRESSING REINFORCEMENTS

(75) Inventors: Jean-François Nieto, Maurepas (FR); Benoît Lecinq, Paris (FR); Fernand De Melo, Paris (FR)

(73) Assignee: Freyssinet International (STUP), Velizy cedex (FR)

( * ) Notice: Subject to any disclaimer, the term of this patent is extended or adjusted under 35 U.S.C. 154(b) by 51 days.

(21) Appl. No.: 10/471,916

(22) PCT Filed: Mar. 8, 2002

(86) PCT No.: PCT/FR02/00840

§ 371 (c)(1),
(2), (4) Date: Sep. 15, 2003

(87) PCT Pub. No.: WO02/075069

PCT Pub. Date: Sep. 26, 2002

(65) Prior Publication Data

US 2004/0139670 A1 Jul. 22, 2004

(30) Foreign Application Priority Data

Mar. 15, 2001 (FR) ..... 01 03537

(51) Int. Cl.
*E04C 5/12* (2006.01)
*E04C 5/08* (2006.01)

(52) U.S. Cl. ..... 52/223.3; 52/223.13

(58) Field of Classification Search ..... 52/223.13, 52/223.14, 223.3

See application file for complete search history.

(56) References Cited

U.S. PATENT DOCUMENTS

| | | | | | |
|---|---|---|---|---|---|
| 1,086,295 | A | * | 2/1914 | Hillman | 52/223.3 |
| 3,146,549 | A | * | 9/1964 | James | 52/223.3 |
| 3,216,162 | A | * | 11/1965 | Gerber et al. | 52/223.13 |
| 3,300,942 | A | * | 1/1967 | Horstman | 52/745.09 |
| 3,523,063 | A | * | 8/1970 | Zerna | 376/296 |
| 3,696,573 | A | * | 10/1972 | Zerna et al. | 52/223.2 |
| 3,722,158 | A | | 3/1973 | Dykmans | |
| 3,795,949 | A | * | 3/1974 | Shorter | 24/115 R |
| 3,888,596 | A | * | 6/1975 | Kelly | 403/314 |
| 3,950,840 | A | * | 4/1976 | Dietrich | 29/452 |
| 3,973,297 | A | * | 8/1976 | Bruinette | 24/122.6 |
| 4,045,929 | A | * | 9/1977 | Velo Dalbrenta | 52/223.2 |
| 4,155,210 | A | * | 5/1979 | de Leaumont | 52/745.01 |
| 4,207,716 | A | * | 6/1980 | Moldrup | 52/223.3 |

(Continued)

FOREIGN PATENT DOCUMENTS

CH 552 737 A 8/1974

(Continued)

*Primary Examiner*—Carl D. Friedman
*Assistant Examiner*—Gay Ann Spahn
(74) *Attorney, Agent, or Firm*—Banner & Witcoff, Ltd.

(57) ABSTRACT

The anchoring device, for anchoring at least two reinforcements for prestressing a civil engineering works structure, has a block through which there pass at least two pairs of anchoring orifices arranged symmetrically on each side of a mid-plane of the block. The two orifices of each pair have axes substantially parallel to the mid-plane and are directed toward two opposite sides of the block to take, respectively, two ends of a taut reinforcement surrounding the structure. The block has a bearing zone pressed against the structure in response to the tension in the reinforcements.

10 Claims, 3 Drawing Sheets

U.S. PATENT DOCUMENTS

| | | | | | |
|---|---|---|---|---|---|
| 4,628,649 | A | * | 12/1986 | Jartoux | 52/223.13 |
| 4,662,134 | A | * | 5/1987 | Illgner | 52/223.13 |
| 4,663,907 | A | * | 5/1987 | Garcia-Mansilla Ripoll | 52/223.13 |
| 4,680,906 | A | * | 7/1987 | Prevedini | 52/223.13 |
| 5,066,167 | A | * | 11/1991 | Siegfried et al. | 405/150.1 |
| 5,251,421 | A | * | 10/1993 | Friedrich et al. | 52/749.1 |
| 5,671,572 | A | * | 9/1997 | Siller-Franco | 52/223.8 |
| 5,701,707 | A | * | 12/1997 | Sorkin | 52/223.13 |
| 5,720,139 | A | * | 2/1998 | Sorkin | 52/223.13 |
| 5,913,641 | A | * | 6/1999 | Long | 405/302.2 |
| 6,247,279 | B1 | * | 6/2001 | Murat et al. | 52/223.3 |
| 6,560,939 | B2 | * | 5/2003 | Sorkin | 52/223.13 |
| 6,584,738 | B1 | * | 7/2003 | Andra et al. | 52/223.14 |
| 2004/0065030 | A1 | * | 4/2004 | Zambelli et al. | 52/223.13 |

FOREIGN PATENT DOCUMENTS

| | | | |
|---|---|---|---|
| DE | 20 17 088 | A | 10/1971 |
| DE | 32 03 592 | * | 8/1983 |
| DE | 86 08 882 | U | 5/1986 |
| DE | 38 06 759 | * | 9/1989 |

* cited by examiner

DEVICE FOR ANCHORING PRESTRESSING REINFORCEMENTS

BACKGROUND OF THE INVENTION

The present invention relates to anchoring devices for anchoring the ends of reinforcements intended to stress a civil engineering works structure (reservoir, silo, pipe, etc)

It is commonplace for a civil engineering works structure to be reinforced by hoop reinforcements which may in particular consist of prestressing strands. These reinforcements are kept taut in a configuration in which they surround the structure. Their tensioning therefore generates compressive stresses in the structure, and these can improve its behavior under load, particularly in the case of concrete structures.

A known anchoring device consists of a block intended to press at its base on a civil engineering works structure and provided with orifices in which the ends of a reinforcement surrounding the structure are immobilized, for example using wedge-effect jaws arranged in opposition.

The orifices of such a block have to lie approximately in the continuation of the path of the reinforcement along the structure. If they do not, the taut reinforcement has a zone of steep curvature at the mouth of the orifice where it carries the risk of being weakened. This arrangement also prevents undesirable moments from being exerted on the block as the reinforcement is tensioned.

However, the two orifices of the block which are intended to receive the opposite ends of the reinforcement cannot be coincident. For space reasons, the orifices and the immobilizing means (jaws or the like) have to be mutually offset.

In order to meet these two requirements, the orifices of the block are given curved shapes: on the two opposite sides of the block, the (entry) directions of the two orifices are aligned in such a way as to lie in the plane of the turn described by the reinforcement around the structure; then the orifices curve away from this plane on each side in order to leave enough space for the tensioning and immobilizing means to be installed.

One disadvantage of the anchoring blocks of this last type is that the curvature of the orifices impedes the insertion of the reinforcements. These have a certain stiffness which opposes their entry into curved orifices. In practice, recourse has to be had to ram-powered tools in order to introduce the reinforcements into the anchoring block, and this considerably complicates the fitting of the prestressing system. In addition, such anchoring cannot be used when it is desirable for the reinforcement to describe more than one turn between its two anchored ends.

It is a particular object of the present invention to alleviate these disadvantages by proposing an anchoring device which adequately meets the above requirements and is easier to mount on the civil engineering works structure.

SUMMARY OF THE INVENTION

To this end, according to the invention, an anchoring device anchoring at least two reinforcements for prestressing a civil engineering works structure comprises a block through which there pass at least two pairs of anchoring orifices arranged symmetrically on each side of a mid-plane of the block. The two orifices of each pair have axes roughly parallel to said mid-plane and are directed toward two opposite sides of the block to take, respectively, two ends of a taut reinforcement surrounding said structure. The block comprises a bearing zone pressed against the structure in response to the tension in the reinforcements.

The symmetric arrangement of the pairs of orifices on each side of the mid-plane allows the moments exerted on the block to be balanced because of the tensioning of the reinforcements. As a consequence, the orifices do not need to have significant curvature in order to allow the reinforcement ends to be immobilized. These reinforcements therefore remain relatively easy to introduce, and this may in particular be done manually.

In some preferred embodiments of the invention, recourse may possibly also be had to one and/or other of the following arrangements:

- there are guide means receiving each reinforcement end in one of the orifices from a reinforcement portion approaching the device at an incidence inclined with respect to a reaction plane perpendicular to the direction of reaction of the structure on the bearing zone in response to the tension in the reinforcements, the reinforcement portions from which the two ends of a reinforcement are received in the orifices of a pair having opposite inclinations with respect to the reaction plane;
- the guide means comprise, for each reinforcement end, a deflector member extending the bearing zone beyond the entrance to the orifice receiving said reinforcement end;
- the orifices of the block have axes roughly parallel to said reaction plane;
- the anchoring orifices of each pair are inclined with respect to a reaction plane perpendicular to the direction of reaction of the structure on the bearing zone in response to the tension in the reinforcements, the inclinations of the orifices of the pair being opposed with respect to the reaction plane;
- the bearing zone of the block comprises at least one groove roughly parallel to the mid-plane of the block, providing a passage for a reinforcement portion held taut against the structure;
- the bearing zone comprises, for each pair of anchoring orifices, a groove roughly parallel to the mid-plane of the block, providing a passage for a central portion of the reinforcement the ends of which are received in the anchoring orifices of said pair to allow said reinforcement to stress the structure over two turns between its anchored ends;
- the bearing zone comprises a central groove roughly parallel to the mid-plane of the block, providing a passage for a portion of a reinforcement anchored by means of another device.

Another aspect of the invention is aimed at a system for prestressing a civil engineering works structure, comprising at least one anchoring device as defined hereinabove and at least two taut reinforcements surrounding said structure, having ends held by said anchoring device.

In some preferred embodiments of this prestressing system, recourse may possibly also be had to one and/or other of the following additional arrangements:

- each reinforcement comprises a metal strand part protected by a tubular sheath made of plastic;
- the sheath of the reinforcement is interrupted near each end received in an orifice of the anchoring block, a sleeve being placed around the portion of the metal strand part of the reinforcement lying between the interruption in the sheath and the entrance to the orifice, the sleeve being connected in a sealed manner to the sheath of the reinforcement and to the block, and the sleeve being filled with a protective material;

a cap covers the orifice of the block on the opposite side to said sleeve, covering a cut-back end of the metal strand part of the reinforcement, a protective material filling the space under the cap;

the exterior shape of the sheath of each reinforcement has a flat on the side applied against the civil engineering works structure.

Another subject of the invention is a prestressing reinforcement comprising a metal strand part protected by a tubular sheath made of plastic, the exterior shape of the sheath having a flat running along the length of the reinforcement. Such a prestressing reinforcement can advantageously be used in the aforesaid prestressing system. However, it can be used in other configurations and with other types of anchoring device.

BRIEF DESCRIPTION OF THE DRAWINGS

Other features and advantages of the invention will become apparent in the course of the following description of two embodiments which are given by way of nonlimiting example with reference to the attached drawings.

In the drawings.

DESCRIPTION OF THE PREFERRED EMBODIMENTS

Figure 2:
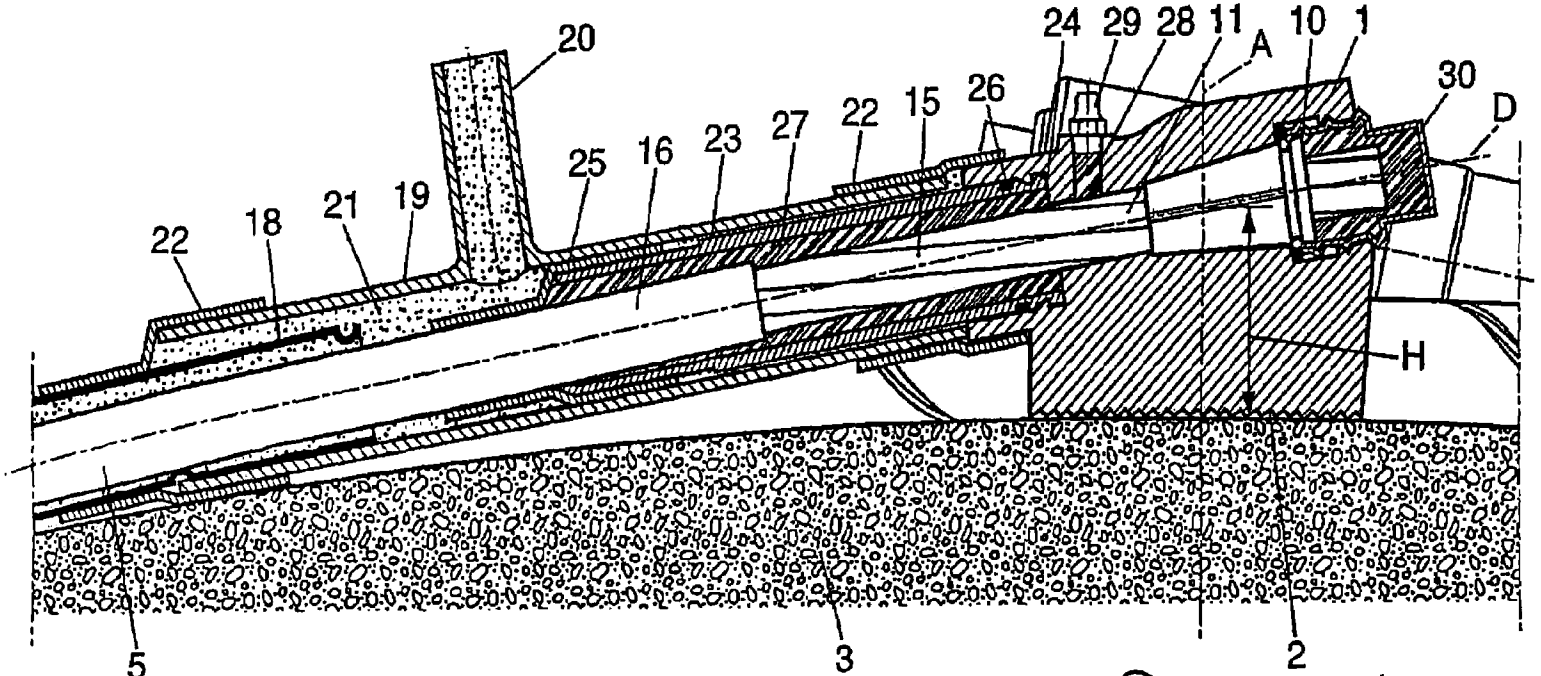
FIG. 2 is a side elevation in section of the anchoring block depicted in FIG. 1, to which reinforcements are connected.
Figure 1:
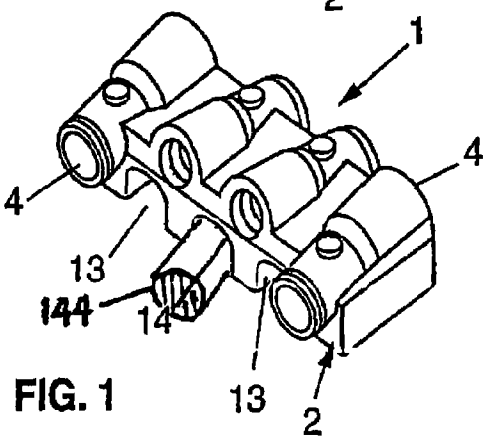
FIG. 1 is a perspective view of an anchoring block that can be used according to the invention.
Figure 3:
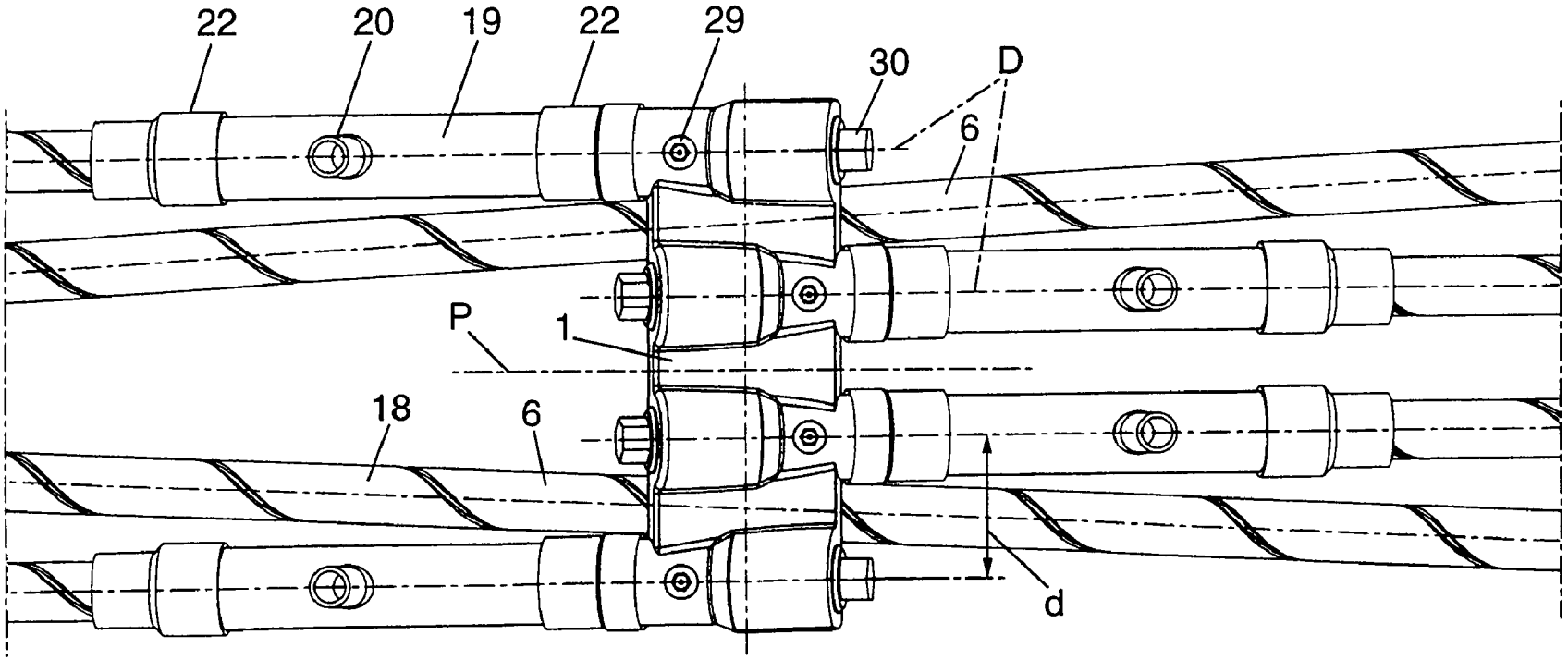
FIG. 3 is a view from above of the anchoring block depicted in FIG. 2.

The anchoring device depicted in FIGS. 1 to 3 comprises an anchoring block 1, made for example of cast iron, intended to bear, via a bearing zone 2, on the external surface of a civil engineering works structure 3 visible in part in FIG. 2.

In the example depicted, the bearing zone 2 has a flat overall shape, possibly with roughnesses to prevent the block from slipping over the structure. The reaction of the structure 3 on the block 1 is exerted in a direction A perpendicular to the plane of the bearing zone. It should be noted that the bearing zone 2 could have various shapes in order to define the reaction direction A.

The anchoring block 1 has passing through it two pairs of anchoring orifices 4 intended respectively to receive the ends of two taut prestressing reinforcements 5.

Each reinforcement 5 surrounds the reinforced structure 3 which is, for example, of circular cross section. The two orifices of the corresponding pair of the block are arranged top-to-toe to retain the two ends of the reinforcement when the latter is tensioned. Because of this tensioning, the bearing zone 2 of the block finds itself pressed against the structure, with a reaction in the direction A.

In the example depicted, the reinforcements consist of strands. After they have been tensioned, their ends 1 are immobilized in the anchoring orifices 4 by means of frustoconical jaws 10 engaged in corresponding frustoconical portions of the orifices 4.

The anchoring orifices 4 are roughly straight, with axes D parallel to a mid-plane P of the block (FIG. 3). To allow the reinforcement ends to be anchored using jaws 10, the two orifices of a pair have an offset d perpendicular to the mid-plane P of the block. The arrangement of the pairs of anchoring orifices 4 is symmetric with respect to the mid-plane P. Thus, the turning moment T.d exerted on the block 1 in the reaction direction A by a reinforcement subjected to a tension T is compensated for by an opposite moment −T.d exerted in the direction A by the other reinforcement, held taut in the same way.

In the embodiment set out in FIGS. 1 to 3, the axes D of the anchoring orifices 4 are inclined with respect to the reaction plane perpendicular to the direction of reaction A, that is to say parallel to the plane of FIG. 3. The inclinations of the orifices of each pair are opposed with respect to this reaction plane, as can be seen in particular in the perspective view that is FIG. 1. By virtue of these inclinations, each reinforcement end 11 received in one of the orifices 4 is aligned with a reinforcement portion approaching the block 1 at an angle of incidence with a corresponding inclination (FIG. 2). They make it possible to take account of the height H between the orifices 4 and the bearing zone 2 while preventing the reinforcement from being stressed transversely at the entrance to the anchoring orifice. Use can then be made of reinforcements whose maximum permissible curvature is determined by the curvature of the reinforced structure rather than by characteristics of the anchoring device.

The device depicted in FIGS. 1 to 3 also has the advantage of allowing each reinforcement to toxin two turns around the structure 3 between its two anchored ends. For that, the bearing zone 2 of the block has two grooves 13 (FIG. 1) approximately parallel to the mid-plane P and associated respectively with the pairs of orifices 4. Each of these grooves 13 (FIG. 1) provides a passage for a central portion 6 of the reinforcement, the ends of which are received in the two orifices 4 of the associated pair (FIG. 3). In this way it is possible to contrive for each taut reinforcement 6 to make two turns around the structure 3 between its two anchoring points in orifices bypassing through a groove 13.

As shown by FIG. 1, the beefing zone 2 of the anchoring block 1 may also have a central groove 14 running parallel to the plane P. This central groove 14 also provides a passage for a reinforcement portion 14A surrounding the structure and anchored in another anchoring device situated at a different location.

For a given binding stress, the grooves 13, 14 make it possible to optimize the number of anchoring means to be used. When the reinforced structure 3 has a cylindrical overall shape (for example a pipe) and it is desirable to adjust the density of taut turns surrounding the structure per unit length, it is thus possible to take advantage of the presence of the grooves 13 and/or 14:

the grooves 13 allow there to be two turns per reinforcement as mentioned earlier;

the grooves 14 make it possible to arrange anchoring devices with different angular positions along the structure. The reinforcements surrounding the structure over just one turn can then pass under the anchoring device of an adjacent reinforcement. For example, the anchoring blocks may be positioned in two rows parallel to the direction of the structure and in positions that are diametrically opposed in the transverse plane, the successive reinforcements being anchored alternately to blocks of the two opposed rows, each reinforcement passing under a block of the opposite row to the one to which it is anchored.

Figure 4:
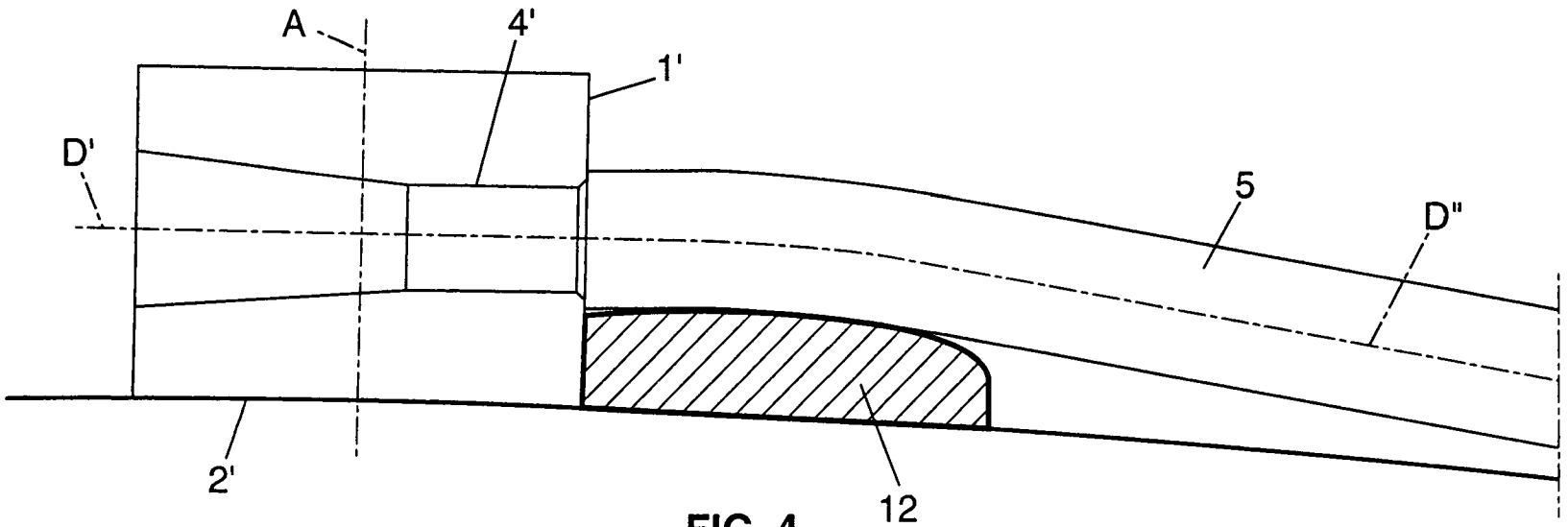
FIG. 4 is a view in section and in elevation of a second embodiment of the anchoring block that can be used according to the invention.

In the alternative form of embodiment of the block that is depicted in FIG. 4, the axes D' of the anchoring orifices 4' of the block 1' are parallel to the reaction plane, that is to say perpendicular to the direction of reaction A defined by the geometry of the bearing zone 2'. To compensate for the angle between this direction D' and the direction of incidence D" of the reinforcement 5 at the approach to the anchoring block 1', a deflective saddle 12 is placed under the reinforcement 5 against the anchoring block 1'. This saddle 12 may form an integral part of the block 1' or constitute a separate piece. It extends the bearing zone 2' beyond the mouth at the entrance to the orifice 4'. Its upper face has a slight curvature tailored to gradually deflect the reinforcement 5 between the directions D" and D'. It thus prevents the reinforcement 5 from having a tendency to form a pronounced angle at the entrance to the orifice 4'.

The reinforcements 5 advantageously consist of individually sheathed strands (FIGS. 2 and 3). The metal strand part 15 of each strand 5 is formed of seven metal wires twisted together, coated in a protective material such as a wax or a grease and housed in an individual sheath made of plastic 16.

Near the anchoring block 1, the sheath 16 is removed to bare the metal strand part 15 which has alone to be gripped by the anchoring jaw 10. To protect the bared portion against corrosion, a sleeve 23 is placed around this portion and connected in a sealed manner to the sheath 16 and to the anchoring block 1 around the entrance to the orifice receiving the strand. The sealed connection of the sleeve 23 to the sheath 16 is achieved for example by means of a sticky and/or heat-shrinkable tape 25. The connection to the anchoring block 1 is, for example, effected by engaging the end of the sleeve 23 in a housing of suitable shape 24 provided around the entrance to the orifice 4 receiving the strand.

In the embodiment depicted in FIG. 2, a second protective envelope is placed around the reinforcement 5. This is an outer tube 18 made of plastic into which the individually protected strand is slipped. A second sleeve 19 surrounds the portion of the end of the strand that protrudes beyond this outer tube 18. This second sleeve 19 is connected in a sealed manner, for example using sticky and/or heat-shrinkable tapes 22, to the tube 18 on the one hand and to the anchoring block 1 on the other.

In order to install a prestressing strand in the system depicted in FIGS. 1 to 3, the procedure adopted may be as follows:

the individually protected strand is slipped into its protective tube 18;

the two ends of its metal strand part 15 are bared;

the sleeves 23 are slipped around the strand portions protruding from the tube 18, and the sleeves 19 are slipped around the tube 18;

the bared ends of the strand are engaged in their anchoring orifices 4, something that can be done manually;

the first sleeves 23 and their sealing means 25, 26 are positioned;

the second sleeves 19 along with their sealing means 22 are positioned;

a curable material 21, such as a cement slurry or a resin, is injected into the space between the protective sheath 16 of the strand and its outer tube 18. This injection is performed through a nozzle 20 of the sleeve 19, depicted in FIGS. 2 and 3;

once the curable material 21 has set, the strand is tensioned. The tensioning may be symmetric, a ram pulling on each of the ends of the strand protruding from the anchoring orifices 4. As soon as tensioning is over, the anchoring jaws 10 are pushed into their frustoconical housings. The tensioning may also be performed from just one side, after having positioned a jaw on the opposite end;

once the desired tension has been applied, the ram is removed and the excess length of the strand beyond the jaw 10 is cut off;

a sealed cap 30, for example made of plastic, is fitted behind the block to cover the orifice 4, covering the cut-back end of the metal strand part 15;

finally, a corrosion-proofing material 27 is injected into the orifice 4 in which the taut strand part is housed. This protective material 27, such as a wax or a grease, pervades the space remaining inside the orifice 4 and under the cap 30, and penetrates between the strand and the first sleeve 23. As shown by FIGS. 2 and 3, this injection may be performed through an opening 28 formed in the block 1, using a greasing nipple 29 which after injection is replaced by a plastic stopper.

By thus injecting a curable material 21 beforehand around the individual sheath 16 of the strand, damage to this individual sheath during the tensioning of this strand can be avoided, as explained in European Patent 0 220 113.

Figure 5:
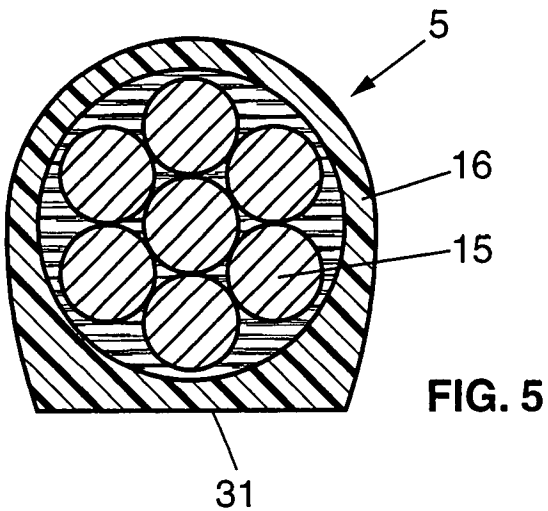
FIG. 5 is a view in section of a prestressing reinforcement according to the invention.

As an alternative, in order to limit the effect of hammering of the sheath along the line of contact between the strand and the prestressed structure, use may be made of a strand that has a single protective sheath made of plastic with an appropriate shape such as that depicted in FIG. 5. In this case, it is possible to dispense with the second envelope 18 and with the injecting of the curable material 21.

With reference to FIG. 5, the exterior shape of the sheath 16 of this strand 5 has a flat 31 running along the entire length of the strand. By applying this flat 31 against the prestressed structure 3, the contact force resulting from the tension in the metal strand part 15 is spread across the width of the flat 31, thus attenuating the maximum value of the compressive stress to which the sheath 16 is subjected.

Such a flat 31 can be obtained by adapting the shape of the die used to extrude the plastic of the sheath 16 during the manufacture of strands. This sheath 16 is typically made of a high density polyethylene.

The invention claimed is:

1. An anchoring device, at least two reinforcements, and a civil engineering works structure, in combination comprising:

a block of said anchoring device having at least two pairs of anchoring orifices arranged symmetrically on each side of a mid-plane of the block, wherein the two orifices of each pair of anchoring orifices have axes substantially included in different planes substantially parallel to said mid-plane and are directed toward two opposite sides of the block; and each of said reinforcements having first and second ends and a central portion and surrounding said civil engineering works structure over two turns;

wherein the block has a bearing zone pressed against the civil engineering works structure in response to tension in the reinforcements, said bearing zone for each of said pairs of anchoring orifices comprising a groove substantially parallel to the mid-plane of the block providing a passage for said central portion of one of said reinforcements and said first and second ends of each of said reinforcements being received in the orifices of said respective one of each of said pairs of anchoring orifices to allow each of said reinforcements to stress the civil engineering works structure over said two turns between the first and second ends thereof.

2. The combination as claimed in claim 1, comprising guide means receiving the first and second ends of each of said reinforcements in the orifices of a respective one of each of said pairs of anchoring orifices from a reinforcement portion approaching the anchoring device at an incidence inclined with respect to a reaction plane perpendicular to a direction of reaction of the civil engineering works structure on the bearing zone in response to the tension in the reinforcements, the reinforcement portions, from which the first and second ends of each of said reinforcements are received in the orifices of a respective one of said pairs of anchoring orifices, having opposite inclinations with respect to the reaction plane.

3. The combination as claimed in claim 2, wherein the guide means comprise, a deflector member extending the bearing zone beyond an entrance to a respective orifice of said orifices of each of said pairs of anchoring orifices receiving one of the first and second ends of each of said reinforcements.

4. The combination as claimed in claim 2, wherein the orifices of each of said pairs of anchoring orifices of the block have axes substantially parallel to said reaction plane.

5. The combination as claimed in claim 1, wherein the orifices of each of said pairs of anchoring orifices are inclined with respect to a reaction plane perpendicular to a direction of reaction of the civil engineering works structure on the bearing zone in response to the tension in the reinforcements, the inclinations of the orifices of each of the pairs of anchoring orifices being opposed with respect to the reaction plane.

6. The combination as claimed in claim 1, wherein the bearing zone comprises a central groove substantially parallel to the mid-plane of the block, providing a passage for a portion for a respective one of said reinforcements.

7. The combination as claimed in claim 1, wherein each of said reinforcements comprises a metal strand part protected by a tubular sheath made of plastic.

8. The combination as claimed in claim 7, including an interruption wherein the sheath for each of said reinforcements is interrupted near each of the first and second ends of each of said reinforcements received in a respective one of the orifices of each of said pairs of anchoring orifices of the block, a sleeve placed around a portion of the metal strand part of each of said reinforcements between said interruption in the sheath and an entrance to a respective one of the orifices of each of the pairs of anchoring orifices, the sleeve being connected in a sealed manner to the sheath of each of said reinforcements and to the block, and a protective material filling each sleeve.

9. The combination as claimed in claim 8, further comprising a cap covering each of the orifices of each of said pairs of anchoring orifices of the block on a side opposite to said sleeve, and covering a cut-back end of the metal strand part of each of said reinforcements, wherein a protective material fills the space under the cap.

10. The combination as claimed in claim 7, wherein an exterior shape of the sheath of each of said reinforcements has a flat on a side thereof which is applied against the civil engineering works structure.

* * * * *